US008915461B2

(12) United States Patent
Singer et al.

(10) Patent No.: US 8,915,461 B2
(45) **Date of Patent: *Dec. 23, 2014**

(54) MANDREL CUPPING ASSEMBLY

(75) Inventors: James Michael Singer, Liberty Township, OH (US); Matthew Alan Russell, Monroe, OH (US); Kevin Benson McNeil, Loveland, OH (US); Frederick Edward Lockwood, Cincinnati, OH (US); Jeffrey Moss Vaughn, Cincinnati, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 141 days.

This patent is subject to a terminal disclaimer.

(21) Appl. No.: 13/568,675

(22) Filed: Aug. 7, 2012

(65) Prior Publication Data

US 2014/0042260 A1 Feb. 13, 2014

(51) Int. Cl.
*B65H 19/30* (2006.01)

(52) U.S. Cl.
USPC ..... 242/533; 242/533.4; 242/533.5

(58) Field of Classification Search
USPC ..... 242/533, 533.4–533.6, 558, 559.2
See application file for complete search history.

(56) References Cited

U.S. PATENT DOCUMENTS

| | | | |
|---|---|---|---|
| 2,769,600 | A | 11/1956 | Kwitek et al. |
| 3,460,773 | A | 8/1969 | Breacker |
| 3,670,979 | A | 6/1972 | Seay |
| 3,733,035 | A | 5/1973 | Schott |
| 3,761,032 | A | 9/1973 | Bahnsen |
| 4,266,735 | A | 5/1981 | Leanna et al. |
| 4,344,584 | A | 8/1982 | Schroeder |
| 4,635,871 | A | 1/1987 | Johnson et al. |
| 4,993,652 | A | 2/1991 | Moeller |
| 5,417,382 | A | 5/1995 | Petitjean et al. |
| 5,435,501 | A | 7/1995 | Alexander et al. |
| 5,667,162 | A | 9/1997 | McNeil et al. |
| 5,690,297 | A | 11/1997 | McNeil et al. |
| 5,725,176 | A | 3/1998 | Vigneau |
| 5,732,901 | A | 3/1998 | McNeil et al. |
| 5,845,867 | A | 12/1998 | Hould et al. |
| 5,934,602 | A | 8/1999 | Jendroska et al. |
| 6,129,304 | A | 10/2000 | Biagiotti |
| 6,595,459 | B2 | 7/2003 | Hanson |
| 7,536,763 | B2 | 5/2009 | Offerhaus |
| 8,042,761 | B2 | 10/2011 | Wojcik et al. |
| 8,096,494 | B2 | 1/2012 | Simonelli et al. |
| 2007/0278342 | A1 | 12/2007 | Harkins |
| 2010/0320307 | A1 | 12/2010 | Pappas et al. |

(Continued)

FOREIGN PATENT DOCUMENTS

| | | |
|---|---|---|
| EP | 2039634 | 8/2012 |

OTHER PUBLICATIONS

PCT International Search Report, mailed Nov. 5, 2013, 202 pages.
U.S. Appl. No. 13/449,377, filed Apr. 18, 2012, Meyer.

(Continued)

*Primary Examiner* — Sang Kim
(74) *Attorney, Agent, or Firm* — Peter D. Meyer

(57) ABSTRACT

A mandrel cupping assembly for releasably engaging unsupported ends of a plurality of mandrels is disclosed. The mandrel cupping assembly comprises a cupping arm turret having a cupping arm turret central axis, a mandrel cup cooperatively associated with each mandrel of the plurality of mandrels, at least three motion limiting devices disposed upon the cupping arms distal from the fulcrum, and a first actuator.

16 Claims, 11 Drawing Sheets

(56) References Cited

U.S. PATENT DOCUMENTS

| | | | | |
|---|---|---|---|---|
| 2011/0057068 | A1 | 3/2011 | Baggot et al. | |
| 2014/0042259 | A1* | 2/2014 | Singer et al. | 242/533.4 |
| 2014/0042261 | A1* | 2/2014 | Singer et al. | 242/533.4 |
| 2014/0042263 | A1* | 2/2014 | Singer et al. | 242/576 |

OTHER PUBLICATIONS

U.S. Appl. No. 13/449,382, filed Apr. 18, 2012, Meyer.
U.S. Appl. No. 13/272,303, filed Oct. 13, 2011, Lockwood, et al.
U.S. Appl. No. 13/272,310, filed Oct. 13, 2011, Lockwood, et al.
U.S. Appl. No. 13/272,312, filed Oct. 13, 2011, Lockwood, et al.

* cited by examiner

MANDREL CUPPING ASSEMBLY

FIELD OF THE INVENTION

The present disclosure relates to automatic web rewinding machines where paper towel stock, bath tissue stock, or the like unwound from very large parent rolls is rewound into smaller individual rolls. In particular, the present disclosure relates to an apparatus that releaseably attaches a mandrel cup into and out of supporting engagement with the free end of a mandrel prior to the winding of the web material upon the mandrel and subsequently detaching the mandrel cup from the mandrel so that the wound web material can removed from the mandrel for additional processing.

BACKGROUND OF THE INVENTION

Typical web rewinding machines provide a number of core supporting mandrels ranging anywhere from four to ten in number which are mounted on an indexingly rotatable turret. The mandrels extend parallel to the horizontal axis about which the turret rotates, and they are spaced at equal distances from the turret axis and at uniform intervals around that axis. By way of example, a typical six-mandrel turret moves through one-sixth of a revolution at each of its indexing movements and hence it carries each mandrel in turn to each of the six successive stations with a period of dwell at each station. By way of yet another example, an exemplary eight-mandrel turret moves through one-eighth of a revolution at each of its indexing movements and hence it carries each mandrel in turn to each of the eight successive stations with a period of dwell at each station. In an alternative embodiment a ten-mandrel turret can rotate at a constant angular velocity and the mandrels travel through a non-circular closed path. In any regard, it should be understood that the number of spindles disposed about any given turret used in a web rewinding machine would likely determine the number of successive, stations in any such device.

In such a configuration, typically one station (sometimes called a first station) is a loading station at which a length of core stock is slid axially onto the mandrel. At the next station, the core stock has an adhesive or glue applied to the surface of the core. At the third station, the mandrel is brought up to winding speed. As the mandrel moves from the third to the fourth station, the web material is attached to the glued core disposed upon the mandrel for the beginning of the winding operation. Winding continues while the mandrel is at the fourth station. As the mandrel moves out of the fourth station, and after the desired length of web has been wound, the web material is cut through across its width (or cross-machine direction) to sever it from the wound roll of web material (e.g., the source of the web material) and give it a new leading edge that is attached to a nm core on the next mandrel moving into the winding station. At the fifth station, the rotation of the mandrel is decelerated to a stop, and at the sixth station a wound core or log is snipped off the mandrel. The mandrel then moves to the first station for a repetition of the cycle.

A conventional turret by which the mandrels are carried comprises a spider which is mounted for a rotation on a coaxial shaft that projects a substantial distance in one direction from the spider. The mandrels have rotating connections with the spider, and they project from it in the same direction as the turret shaft. The rotating connection of each mandrel with the spider must provide cantilevered support of the mandrel because when the mandrel is at the core loading station and the unloading station, the end of the mandrel that is remote from the spider is disengaged from supporting parts and completely accessible to allow cores to be moved axially onto and off. It should be recognized that the mandrels tend to be heavy and very long—typically, 72 inches to 96 inches in length. Therefore, therefore, their free ends are typically supported whenever possible and certainly during winding.

To provide support of the free ends of the mandrels, there is conventionally an assembly of supporting arms or chucks on the end portion of the turret shaft that is remote from the spider. This is also known to those in the art as a mandrel cupping assembly. A mandrel cupping assembly is an assembly that is constrained to indexing rotation concurrent with the spider containing the individual mandrels. The mandrel cupping spider generally comprises a chuck arm (or cup) cooperatively associated with each mandrel. Each chuck arm is generally swingable about an axis which is near the turret axis and transverse thereto between a substantially radially extending closed position in which the free end of the chuck arm supportingly engages the free end portion of its associated mandrel and an open position in which the chuck arm is disengaged from its mandrel and is disposed in a more or less axial orientation alongside the turret shaft. Each chuck arm is operated automatically so that it is in its open position during loading and unloading of the mandrel and is in its closed position at least from the time the mandrel moves into the gluing station and moves out of the deceleration station mentioned supra.

In one embodiment, a conventional mechanism for actuating the mandrel supporting chuck arms is provided with a barrel cam that is fixed to the machine frame adjacent to the free ends of the mandrels and a lever and link arrangement for each chuck arm. Each arrangement is carried by the turret for rotation therewith and having a cam follower roller that rides in a groove in the periphery of the stationary barrel cam. Each chuck arm is actuated at appropriate times in consequence of indexing movement of the turret. The shape of the cam groove is provided so that the chuck arms move in engagement with their respective mandrels when the latter are generally adjacent the glue applicator wheels and retract when the mandrels move from the web material winding position.

In such an operation, the stripping of wound rolls off a mandrel is conventionally accomplished by means of a pusher that engages the log at only one side of the mandrel and provides a lateral force upon the cantilevered mandrel. This can set the mandrel into a vibration mode that may be aggravated by the indexing movement that follows unloading. With the mandrel unsupported at the loading station, its free end often wobbles so severely that the core may not be run onto it with automatic core loading equipment. Such an apparatus is described in U.S. Pat. No. 2,769,600.

It is believed that with such conventional machines, the failure to load a core creates a danger that the mandrel itself would be coated with glue at the gluing station necessitating a lengthy shutdown of the machine for cleaning. An operator, seeing that such an unloaded mandrel was moving out of the unloading station, would be required to stop the machine and would find that there is no way to retract the chuck arm engaged with the empty mandrel to permit manual axial unloading of the core. This is because of the nature of the chuck arm actuating mechanism. One purported solution to this problem was to slit a core along its length and push it laterally onto a mandrel to protect the mandrel from glue. At the conclusion of the winding cycle the individual rolls wound onto the gifted core are then discarded.

It is also believed that wobble of an unsupported mandrel could cause a chuck arm to fail to engage the mandrel properly. One solution proposed was a U-shaped member on each chuck arm that tended to preliminarily engage the mandrel during closing movement of the chuck arm and steady the mandrel sufficiently to enable its conical free end to be received in the bearing socket disposed in the chuck arm. However, it is believed that this expedient is not always successful in practice because as the wobbling mandrel fails to enter the chuck arm socket, the chuck arm mechanism exerts as much force as the indexing mechanism can provide. This can result in the inevitable bending or breakage of the link and lever elements that translate any cam follower motion into swinging motion of the chuck arm. The repair of such damage would be necessarily difficult and time consuming.

It is also believed that another expedient that has been used to prevent damage to the chuck arm actuating mechanism is to mount the barrel cam for limited axial motion and pneumatically bias it towards one limit of such motion. When a chuck arm fails to close properly, the reaction force that is imposed upon the cam moves it against its bias to a position which actuates an emergency stop. However, it is believed that such an emergency shutdown arrangement merely relieves some of the effects of the problem rather than solving the problem itself. By way of example, it will no permit axial loading of a core onto an empty mandrel that had moved out of the loading position.

Other solutions provide an automatic web rewinding machine or an automatic mandrel chucking mechanism that does not employ force derived from the turret indexing to affect chuck arm actuation. The chuck arms move to and from their mandrel supporting positions only during periods of dwell to minimize the likelihood of mandrel vibration at the time chuck arm closing occurs. The mechanism is arranged to allow a chuck arm to be manually controlled for movement to its open position in any position of the turret so that a core can be axially loaded onto an empty mandrel or a defective core or roll can be axially stripped off the mandrel. Such a system is described in U.S. Pat. No. 4,266,735.

In any regard, attempts by the prior art to achieve an automatic web rewinding machines all provide for a single chuck arm and its associated equipment to be cooperatively associated with a respective mandrel. Further, the chuck arm and its associated equipment must cooperatively rotate with the mandrel about the turret axis. In other words, a chuck arm is is constrained to rotate with the turret and is movable relative to and between a closed position (in which the chuck arm supportingly engages the other end of the mandrel) and an open position (in which the chuck arm is disengaged from the mandrel) to permit cores to be moved axially onto and off it. Clearly, the mechanism is unduly complex and requires numerous moving parts and associated ancillary equipment for it to perform its intended function.

Thus, it would be clearly advantageous to provide a turret system and in particular, a mandrel cupping assembly that is less complex and requires fewer moving parts to perform its intended function. In fact, such a system would rotate only the mandrel cup with its respective mandrel free of any associated equipment necessary to load and unload the mandrel cup. Clearly, such systems would be appreciated by one of skill in the art because of their overall simplicity and ease of use.

SUMMARY OF THE INVENTION

The present disclosure provides for a mandrel cupping assembly for releaseably engaging unsupported ends of a plurality of mandrels disclosed on a web winding turret assembly having a web winding turret assembly axis. Each of the plurality of mandrels extends generally parallel to the web winding turret assembly axis. Each of the mandrels is driven in a closed mandrel path about the web winding turret assembly axis. The mandrel cupping assembly comprises a cupping arm turret having a cupping arm turret central axis, a mandrel cup cooperatively associated with each mandrel of the plurality of mandrels, at least three motion limiting devices disposed upon the cupping arms distal from the fulcrum, and a first actuator. Each of the mandrel cups is disposed radially about the cupping arm turret. Each of the mandrel cups comprise a pair of cupping arms configured as a first-class double-lever with a pivot acting as a fulcrum. Each of the mandrel cups releaseably engages the unsupportive end of the mandrel. Each of the mandrel cups has a hold-open position and a hold-closed position. Each of the mandrel cups is carried in a radial orbital path about the cupping arm turret central axis while disposed in either of the hold-open position or the hold-closed position. The first actuator disposes the cupping arms from the hold-open position to the hold-closed position.

DETAILED DESCRIPTION OF THE INVENTION

Figure 1:
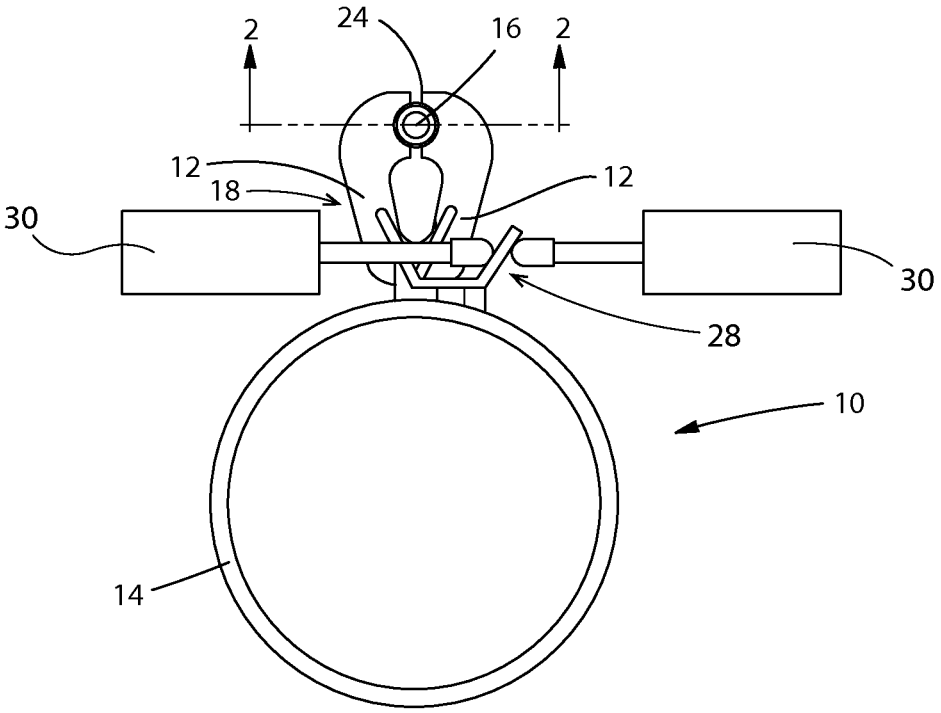
FIG. 1 is a planar end view of an exemplary mandrel cupping assembly of the present disclosure in a closed position.
Figure 2:
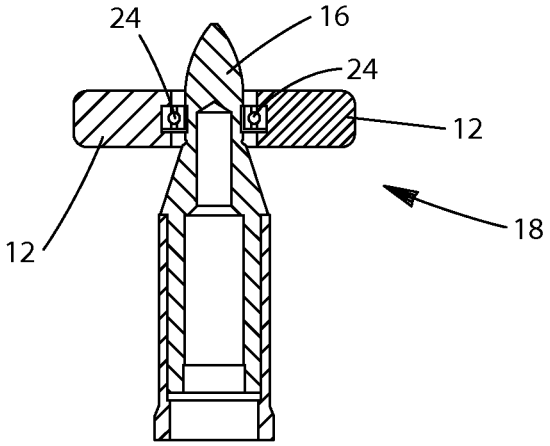
FIG. 2 is a cross-sectional view of the exemplary mandrel cupping assembly of FIG. 1 taken along the line 2-2.
Figure 3:
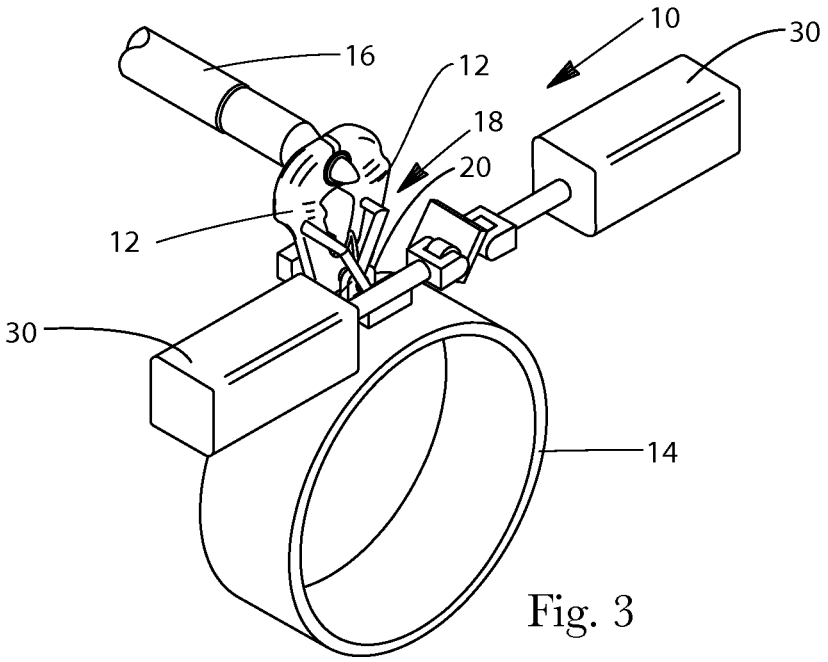
FIG. 3 is a perspective view of the left side of the exemplary mandrel cupping assembly of FIG. 1.
Figure 4:
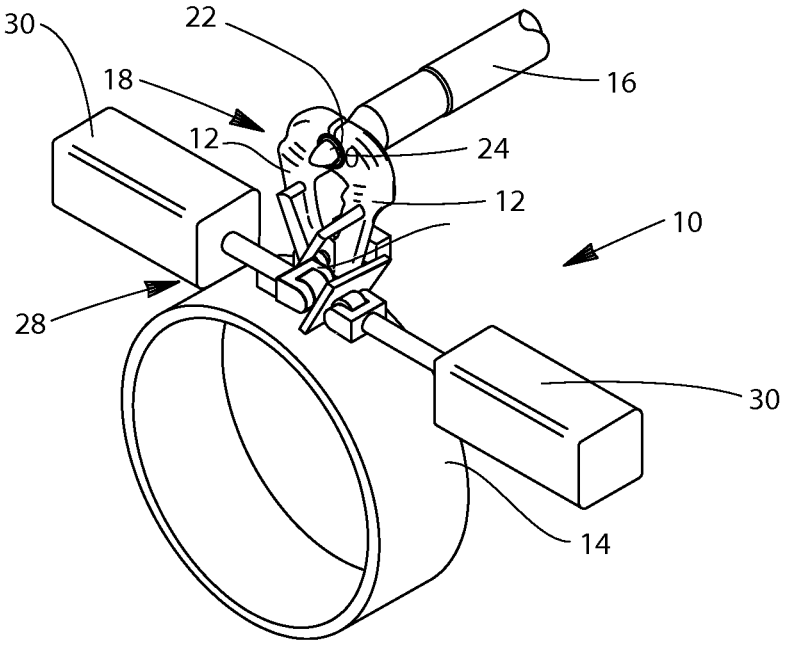
FIG. 4 is a perspective view of the right side of the exemplary mandrel cupping assembly of FIG. 1.
Figure 5:
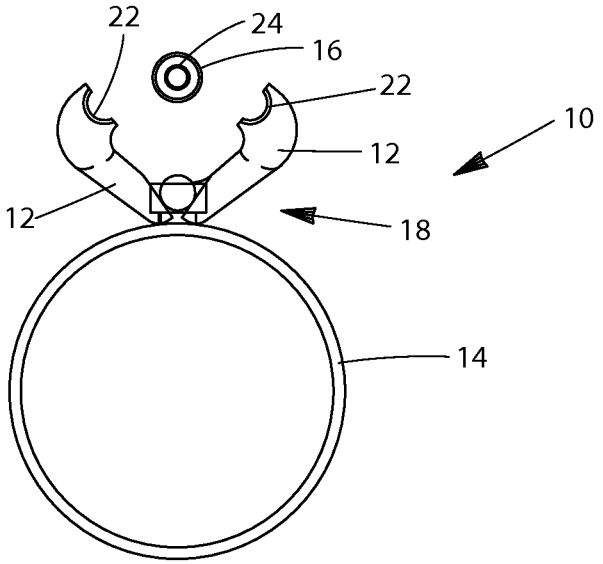
FIG. 5 is a planar end view of the exemplary mandrel cupping assembly of FIG. 1 in an open position.
Figure 6:
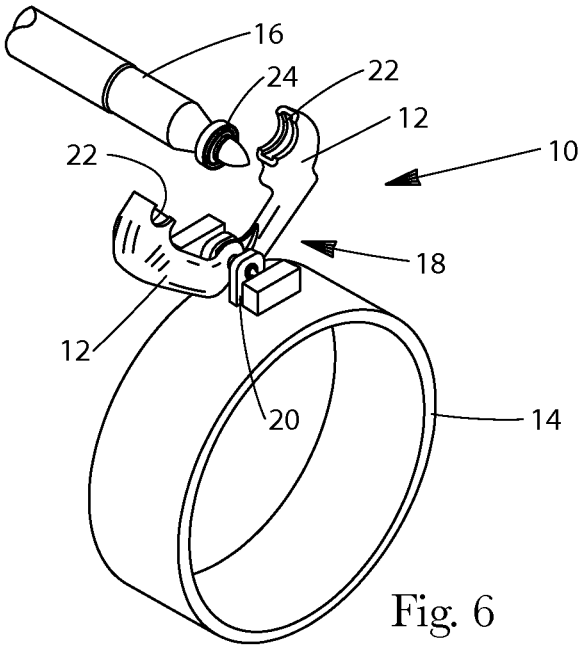
FIG. 6 is a perspective view of the left side of the exemplary mandrel cupping assembly of FIG. 5.
Figure 7:
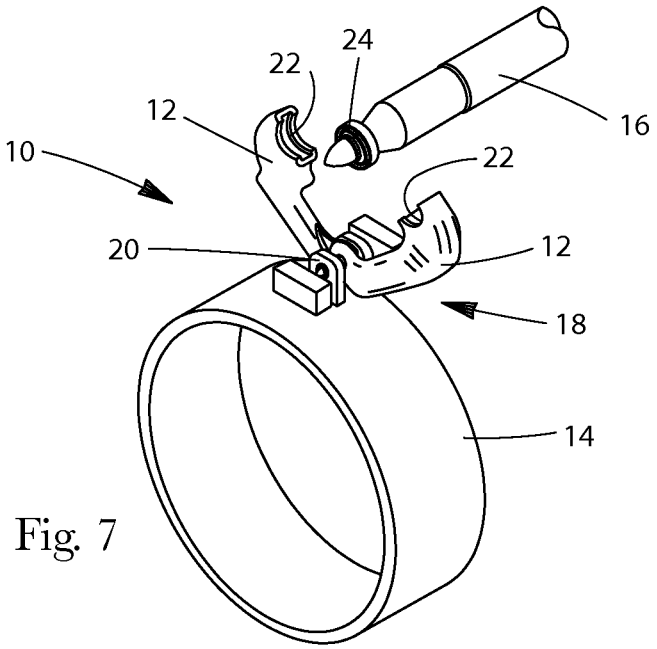
FIG. 7 is a perspective view of the right side of the exemplary mandrel cupping assembly of FIG. 5.

FIGS. 1-7 of the present disclosure depict various perspective and planar views of an exemplary cupping assembly 10. While only one mandrel cup 18 is provided for illustrative purposes, it should be readily understood by one of skill in the art that the mandrel cupping assembly 10 would naturally be provided with a plurality of mandrel cups 18. In the exemplary embodiment shown, the mandrel cupping assembly 10 is provided with mandrel cups 18 each mandrel cup 18 having cupping arms 12 disposed about a cupping spider 14 that are placed into contacting and un-contacting engagement with the free end of a web re-winding mandrel 16. In other words, a mandrel cup 18 releaseably engages the unsupported end of a mandrel 22 and supports the mandrel 22 for rotation of the mandrel 22 about its own rotational axis as well as its rotation (i.e., orbit) about the axis of a turret assembly. In this embodiment, the mandrel cup 18 can be provided in a passive configuration for movement (i.e., orbit) about cupping spider 14. In a passive configuration, it is envisioned that the inertia of a particular spindle 22 due to its rotation about the axis of the turret assembly, once in mating engagement with a corresponding mandrel cup 18, will be sufficient to cause the corresponding mandrel cup 18 to orbit about cupping spider 14 in a cooperative manner coincident with the mandrel 16 cooperatively associated thereto.

In a preferred embodiment, a mandrel cup 18 is provided by a pair of cupping arms 12 that are provided as a first-class double-lever with a pivot acting as a fulcrum 20 (similar to a scissor). For situations where the mandrel cup 18 is envisioned to support a heavy mandrel 16 or in situations where a product disposed about mandrel 16 has high inertia, the mechanical advantage can be exploited by placing the mandrel 18 as close to the fulcrum 20 as possible. The ends of cupping arms distal from the fulcrum 20 can be provided with detents for releaseably engaging the unsupported end of a mandrel 22 and supporting the mandrel 22 for rotation of the mandrel 22 about its own rotational axis as well as its rotation (i.e., orbit) about the axis of a turret assembly. The unsupported end of the mandrel 16 can provided with a bearing 24 that is matingly engageable detents 22 provided upon the distal end of each cupping arm 12. In an alternative embodiment, the distal ends of cupping arms 12 forming detents 22 can be provided with opposed portions of a bearing surface or sleeve that provides mating engagement with the unsupported end of mandrel 16.

The exemplary cupping assembly 10 is generally presumed to be cooperatively engaged and mated with a corresponding web rewinding machine and the relevant portion of an exemplary, non-limiting embodiment of a turret assembly suitable for use as an automatic web rewinding machine. As would be appreciated by one of skill in the art, a plurality of rotatable core supporting mandrels 16 are carried in an indexable, orbital motion about the axis of the turret assembly as well as for rotation about their own respective axes. A turret assembly of the present disclosure generally provides a spider by which the respective mandrels 16 are carried and a shaft by which the spider is supported for rotation. The turret shaft projects a substantial distance in one direction from the spider and the mandrels 16 disposed thereupon project from the spider a somewhat smaller distance in the same direction. One of skill in the art will appreciate that since the rotatable connection between the spider and each of the long, relatively heavy mandrels 16 is near one end of the mandrel 16 and the other end of the mandrel 16 will be unsupported at times, the spider will typically be provided with two axially spaced apart bearings for each mandrel so that the cantilevered connection of the mandrel 16 with the spider can, by itself, hold the mandrel 16 reasonably steady. As will be appreciated by one of skill in the art, it is preferred that each mandrel 16 be provided equidistant from the axis of the turret and are uniformly spaced about that axis. Additionally, it would be recognized by one of skill in the art can provide the position of mandrel 16 (i.e. radius) relative to the turret axis can change as the mandrel 16 moves from one station to the next. This can be considered a form of continuous-motion turret. Further the mandrels can be positioned for the disposition of material thereupon by use of the so-called open-loop configuration.

Each mandrel 16 can be driven to provide the required rotation in any conventional manner. One form of a mandrel drive, apparatus can provide rotation of each mandrel 16 and its associated core disposed thereabout the mandrel axis during movement of the mandrel 16 and core combination. The mandrel drive apparatus can provide winding of a web material upon the core supported on the mandrel 16 to form a log of web material wound around the core (a web wound core). This form of mandrel drive apparatus can provide center winding of the web material upon the cores (that is, by connecting the mandrel with a drive which rotates the mandrel 16 about its axis, so that the web material is pulled onto the core). The mandrel 16 can be provided with a profiled rotation that provides a constant surface speed while the diameter of the winding product increases throughout the winding cycle. Alternatively, the mandrel 16 can be provided with a winding profile that provides a differential surface speed at desired points throughout the winding cycle.

As one of skill in the art will appreciate, each mandrel 16 can be connected at its end adjacent to the spider (not shown) with a form of coaxial clutch that provides a disengageable driving connection between the mandrel 16 and a coaxial sheave. Typically, the sheave is connected by means of a belt with a pulley and is rotatable on the turret shaft and in turn a belt drivingly connects the pulley with a motor which can be provided at a fixed location relative to the frame of the turret assembly. Such assemblies are described in U.S. patent application Ser. No. 06/113,465.

Further, one of skill in the art will appreciate that a turret assembly having a turret (not shown) is typically indexingly rotated to carry each of the mandrels 16 to each of a succession of fixed stations at each of which the mandrel dwells for a time during the performance of an operation distinctive to the particular station. The arrangement of the stations, the operation or operations at each, and the apparatus provided at the several stations for the performance of their function are all generally known to those of skill in the art familiar with web rewinding machines.

In one exemplary, but non-limiting embodiment, each mandrel 16 can be provided with a toothed mandrel drive pulley and a smooth surfaced free wheeling idler pulley, both disposed near the mandrel end adjacent to the spider. The positions of the drive pulley and idler pulley alternate on every other mandrel 16, so that alternate mandrels 16 are driven by their respective mandrel drive belts. For instance, when a mandrel drive belt engages the mandrel drive pulley on its associated mandrel 16, the mandrel drive belt can ride over the smooth surface of the idler pulley on that same mandrel 16, so that only the respective drive motor provides rotation of that mandrel 6 about its axis. Similarly, when the mandrel drive belt engages the mandrel drive pulley on an adjacent mandrel 16, the mandrel drive belt can ride over the smooth surface of the idles pulley on that respective mandrel 16, so that only that drive motor provides rotation of the mandrel about its axis. Accordingly, each drive pulley on an associated mandrel 16 engages one of the belts to transfer torque to the mandrel, and the idler pulley engages the other of the belts, but does not transfer torque from the drive belt to the mandrel.

As would also be understood by one of skill in the art, a length of tubular core stock from a supply thereof is advanced axially by known mechanisms to be loaded onto a particular mandrel 16. Typically, a mandrel 16 has a conical or "bullet"-shaped nose free end portion to assist in guidance of the cores into a coaxial relationship thereto.

Similarly, after the winding of a web material into a wound product upon acorn disposed upon an associated mandrel 16, it was found that a generally conventional mandrel unloading mechanism can provide the individual rolls of wound product to be stripped off a particular mandrel 16 at an unload station. In one embodiment, the unloading mechanism may comprise an endless belt arranged to have a long, straight stretch which extends parallel to the mandrel 16 at the unloading station at a small distance to one side of that mandrel 16. A pusher can be secured to the belt and can project laterally therefrom to engage from behind a log of wound product 46 and drive it elf the mandrel 16 as the pusher moves away from the spider along a straight stretch.

Alternatively, a core stripping apparatus can be positioned along the unload station. An exemplary core stripping apparatus can comprise a driven core stripping component, such as an endless conveyor belt. The conveyor be preferably carries a plurality of flights spaced apart on the conveyor belt. Each flight can engage the end of a log supported on a mandrel 16 as the mandrel 16 enters the unload station.

A flighted conveyor belt can be angled with respect to a respective mandrel 16 axis as the mandrels 16 are carried along a generally straight hue portion of the core unload station so that the flights engage each leg disposed about a mandrel 16 with a first velocity component generally parallel to the mandrel 16 axis, and a second velocity component generally parallel to the straight line, portion of the unload station. Once the log is stripped from the respective mandrel 16, the mandrel 16 can be carried along the closed mandrel path to the core loading station to receive another core.

As shown generally in FIGS. 1-7, one of skill in the art will recognize that during both unloading and loading of a mandrel 16, the end of a mandrel 16 that is remote from the spider must be unsupported. However, as the mandrel 16 moves through the portion of its orbit about the axis of the turret assembly that takes it from the loading station around to an unloading station, its free end portion is preferably supported by a mandrel cupping assembly 10 having opposed cupping arms 12 disposed about a cupping spider 14 that are placed into contacting and un-contacting engagement with the free end of the mandrel 16.

In other words, a mandrel cup 18 releaseably engages the unsupported end of a mandrel 16 and supports the mandrel 16 for rotation of the mandrel 16 about its own rotational axis as well as its rotation (i.e., orbit) about the axis of the turret assembly. In this embodiment, the mandrel cup 18 is in an active configuration for coincident movement with cupping spider 14. In an active configuration, it is envisioned that the cupping spider 14 will provide the inertia to necessary to provide cooperative movement of the respective mandrel cup 18 with the mandrel 16 associated thereto.

However, one of skill in the art will recognize that mandrel cup 18 can also be provided in a passive configuration of a particular mandrel 16. Movement in this passive configuration can be due to its rotation about die axis of the turret assembly once in mating engagement with a corresponding mandrel cup 18. It is believed that this movement can be sufficient to cause the corresponding mandrel cup 18 to orbit about cupping spider 14 while disposed in a groove, on a track, or other means in a cooperative manner coincident with the mandrel 16 cooperatively associated thereto. In such a passive configuration, it is envisioned that the inertia of a particular mandrel 16 due to its rotation about the axis of the turret assembly, once in mating engagement with a corresponding mandrel cup 18, will be sufficient to cause the corresponding mandrel cup 18 to orbit about cupping spider 14 in a cooperative manner coincident with the mandrel 16 cooperatively associated thereto.

In a preferred embodiment, a particular mandrel cup 18 is cooperatively associated with each mandrel 22. A mandrel cup 18 of mandrel cupping assembly 10 releaseably engages the unsupported end of a mandrel 15 intermediate the core loading segment and the core stripping segment of the closed mandrel path as the mandrels 16 are driven around the turret assembly axis by the rotating turret assembly.

In certain embodiments, when a turret assembly comprises four mandrels 16, naturally there will be four mandrel cups 18 disposed radially about cupping spider 14—each mandrel cup 18 providing cooperative engagement with each respective mandrel 16. Similarly, a turret assembly having six, eight, or ten mandrels 16 disposed thereabout, a cupping assembly 10 will have respectively six, eight, or ten respective, mandrel cups 18 disposed radially about cupping spider 14.

In any regard, each mandrel 16 associated with the turret assembly is provided with a corresponding mandrel cup 18 that is disposed radially about cupping spider 14 of cupping assembly 10. Each mandrel cup 18 preferably orbits with, or about, cupping spider 14 in a cooperative motion with a respective mandrel 16 (depending upon either active or passive movement about cupping spider 14), in a passive configuration, such rotary motion can carry a respective mandrel cup 18 to rotate about or orbit about the axis of cupping assembly 14 in a singular track. As used herein a "track" should be broadly construed to provide a path or line for travel or motion for sliding or rolling a part or parts. As such, a "track" may include any device, apparatus, or assembly that prevents the unwanted movement from one portion of a device or assembly to another. Non-limiting examples of various tracks may include a race, a cam, a trace, a channel, groove, a rail, or the like all of which are used interchangeably and combineably herein without limitation.

It should be noted that cupping assembly 10 can be capable of providing the mandrel cup 18 in a "tensioned" operative position in which the respective mandrel cup 18 supportingly engages the free end portion of a cooperatively associated mandrel 16 and is positioned upon cupping spider 14 in a position that provides a tension to mandrel 16. This additional motion was found to assist in the reduction of vibrations in the web winding equipment during operation.

Generally, cupping arms 12 remain in a radially up-right position relative to cupping spider 14 when in contacting and non-contacting engagement with a respective mandrel 12. In a preferred embodiment, when mandrel cup 18 is not in contacting engagement with as respective mandrel 16, cup in arms 12 remains in a radially up-right position relative to cupping spider 14 but rotate radially about fulcrum 20. Rotation of cupping arms 12 about fulcrum 20 causes the respective cupping arms 12 to rotate to a position radially away from mandrel 16 in a direction that is generally oriented toward the surface of cupping spider 14. In this position the cupping arms 12 of mandrel cup 18 are preferably removed from the region proximate to mandrel 16 thereby allowing mandrel 16 to become unsupported for the removal of any product wound thereabout. Additionally, cupping arms 12 are preferably disposed sufficiently away from mandrel 16 to clear the log being removed and account for mandrel 16 droop.

Coincident with the removal of cupping arms 12 of mandrel cup 18 from the end of mandrel 16 any tension applied by mandrel cup 18 upon mandrel 16 can be released by the movement of mandrel cup 18 in a direction parallel to the longitudinal axis of cupping spider 14. In a preferred embodiment the mandrel cup 18 is moved inward relative to mandrel 16 along the surface of cupping spider 14 and then cupping arms 12 are rotated about fulcrum 20 in a direction away from mandrel 16 to enable removal of any material wound about mandrel 16 during processing.

Each cupping arm 12 can be further provided with a ring at an end distal from cupping spider 14 and preferably comprises a bearing socket in which the generally conical end portion of the mandrel 16 is receivable. The ring an provide locking engagement with the unsupported end of mandrel 16. Such locking engagement can be provided through the use of locking pins, a 'snap-lock', magnets, gears, deformable rings and the like. In any regard, it is preferred that the unsupported end of a corresponding mandrel 16 be capable of rotation within the engaged portion of cupping arms 12 while not being able to withdraw from the 'locked' position while the cupping arms 12 are in a closed position relative to mandrel 16.

Figure 8:
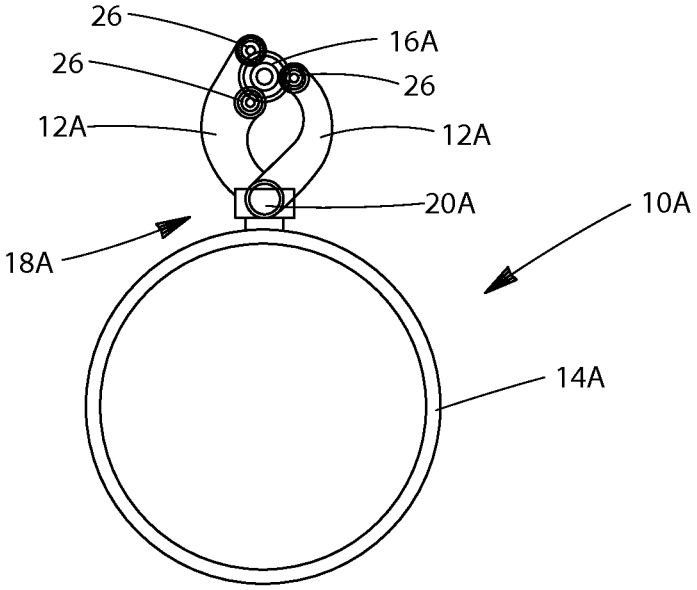
FIG. 8 is a planar end view of an another exemplary mandrel cupping assembly of the present disclosure in a closed position.
Figure 9:
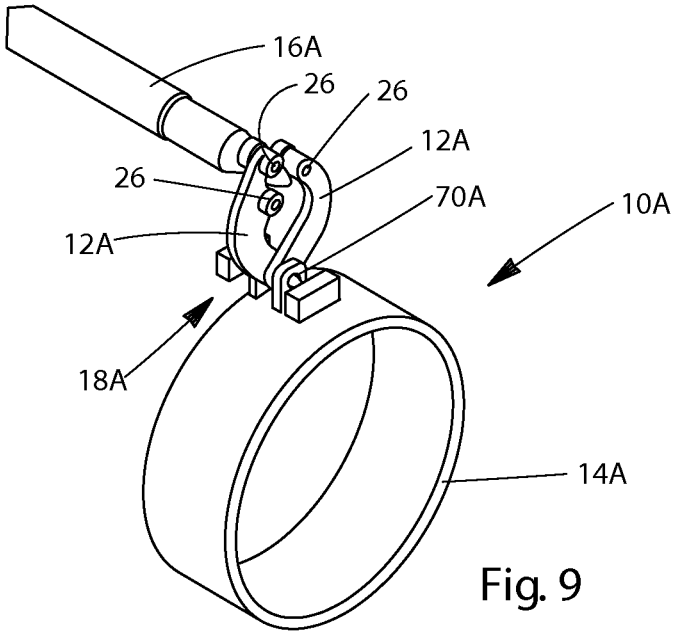
FIG. 9 is a perspective view of the left side of the exemplary mandrel cupping assembly of FIG. 8.
Figure 10:
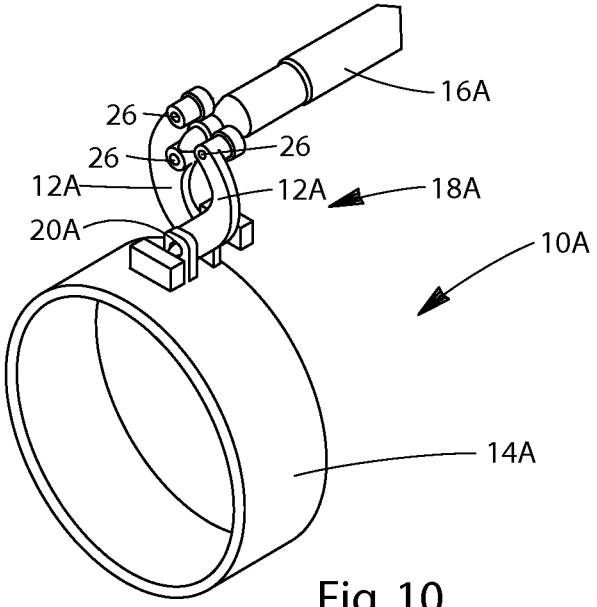
FIG. 10 is a perspective view of the right side of the exemplary mandrel cupping assembly of FIG. 8.
Figure 11:
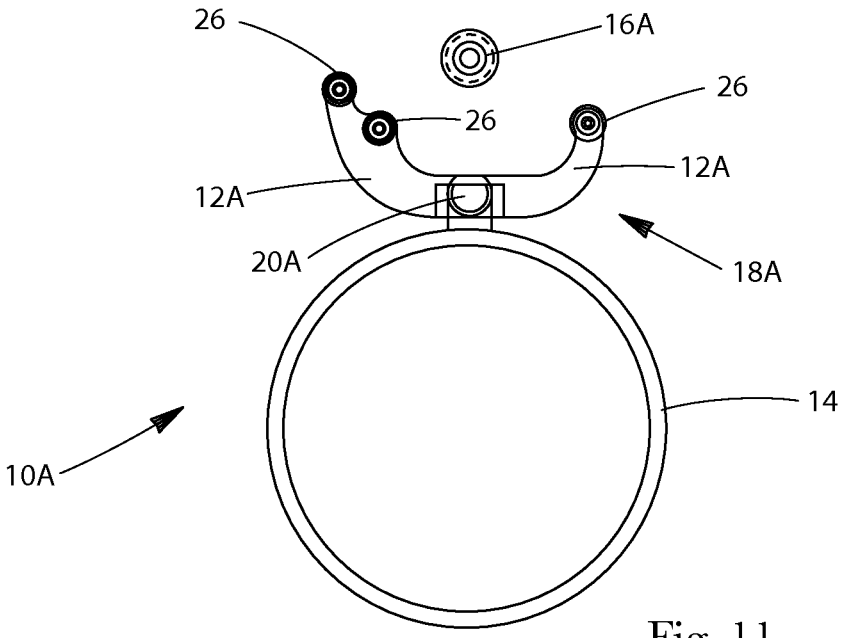
FIG. 11 is a planar end view of the exemplary mandrel cupping, assembly of FIG. 8 in an open position.
Figure 12:
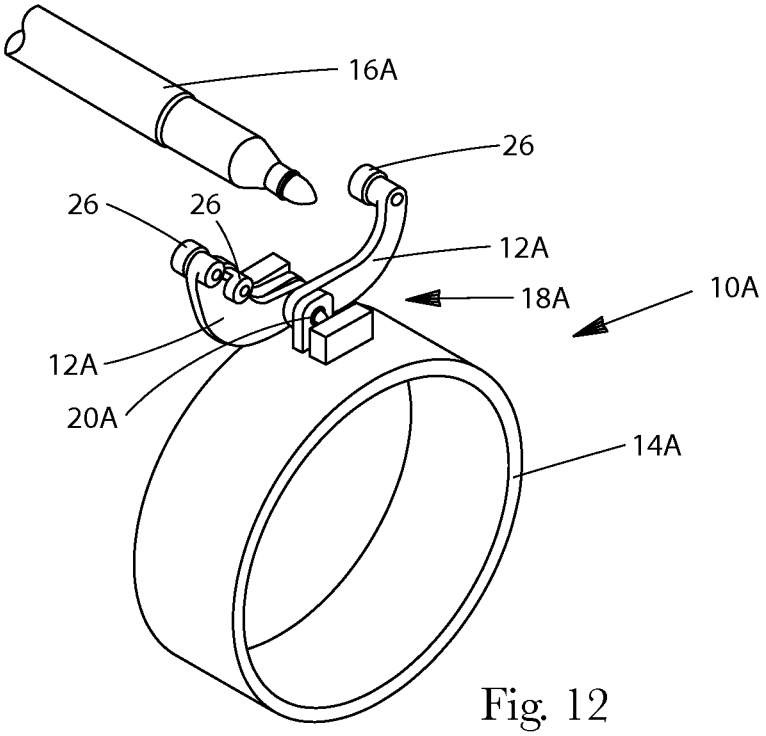
FIG. 12 is a perspective view of the left side of the exemplary mandrel cupping assembly of FIG. 11.
Figure 13:
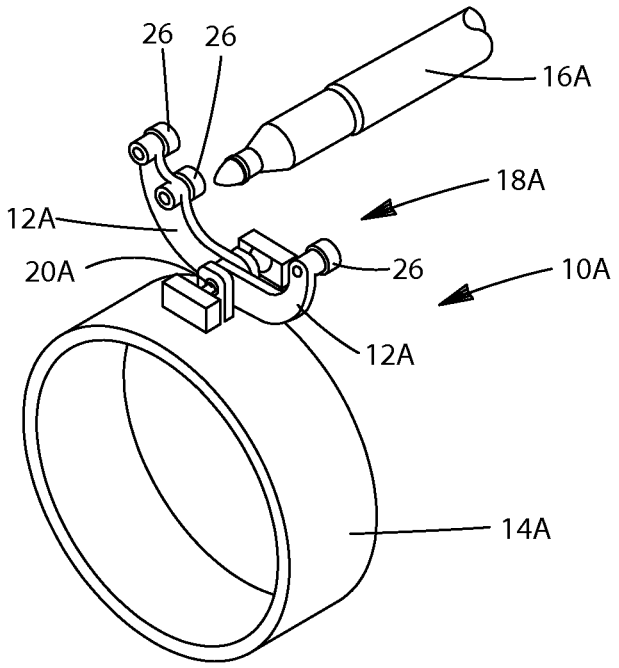
FIG. 13 is a perspective view of the right side or the exemplary mandrel cupping assembly of FIG. 11.
Figure 14:
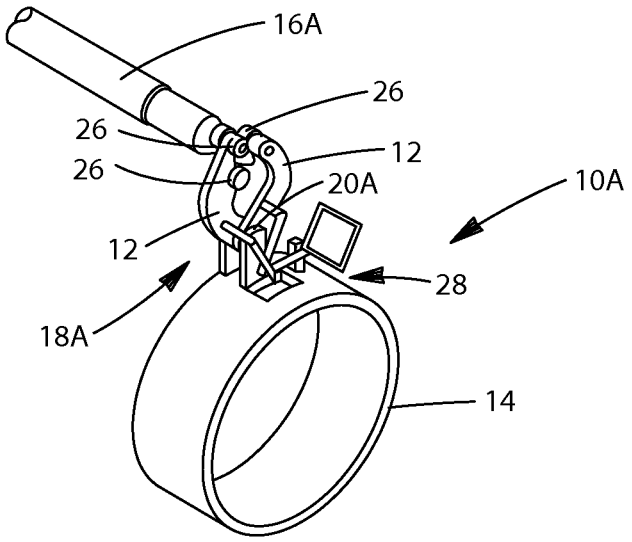
FIG. 14 is a perspective view of the right side of the exemplary mandrel cupping assembly of FIG. 11 in a closed position showing an exemplary actuation scheme.
Figure 15:
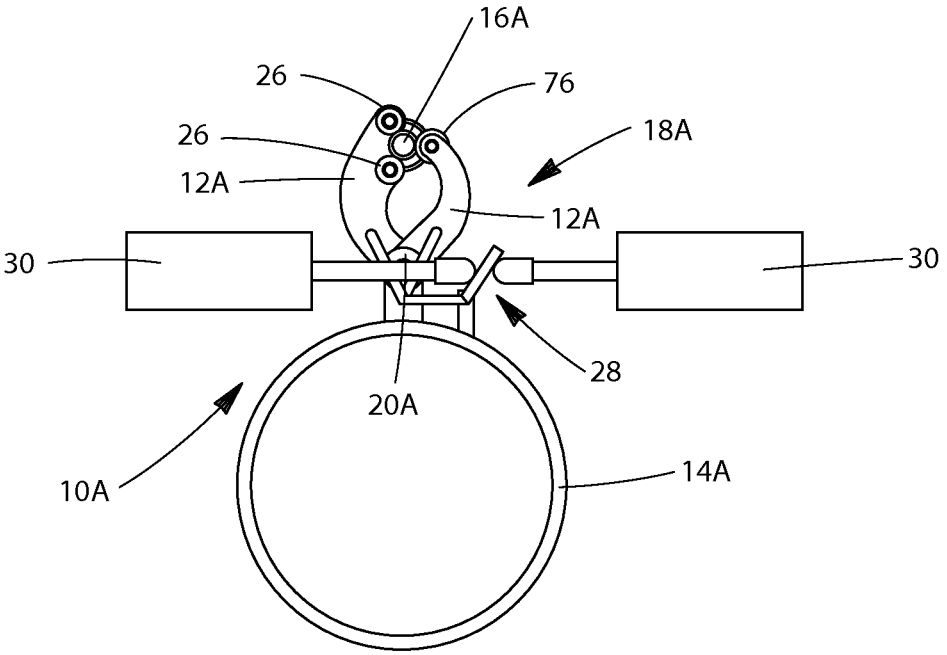
FIG. 15 is a planar end view ox the exemplary mandrel cupping assembly of FIG. 11 in a closed position showing an exemplary actuation scheme with actuators.
Figure 16:
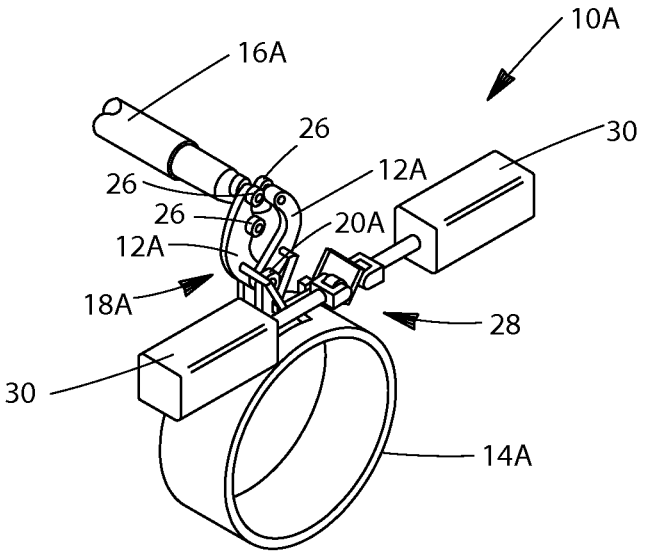
FIG. 16 is a perspective view or the left side of the exemplary mandrel cupping assembly of FIG. 15.
Figure 17:
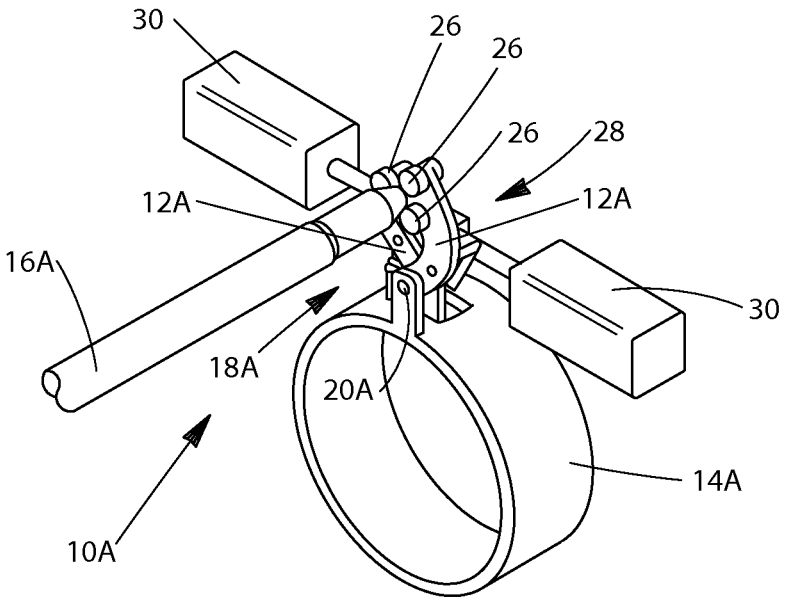
FIG. 17 is an alternative perspective view or the exemplary mandrel cupping assembly of FIG. 15.
Figure 18:
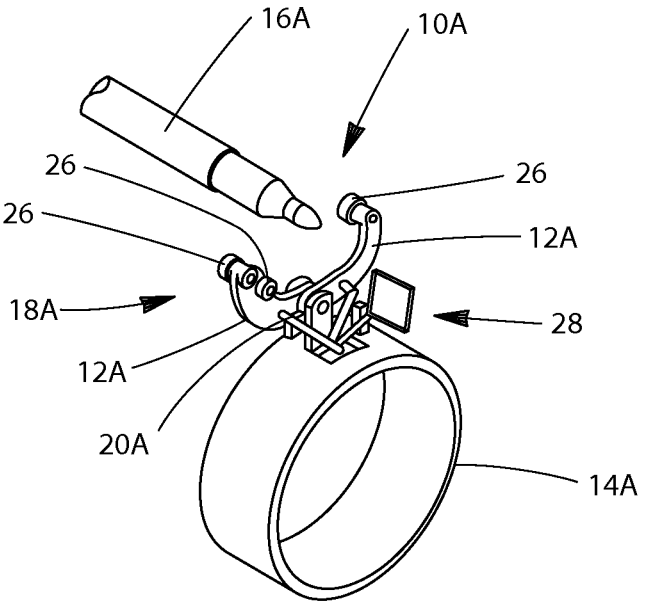
FIG. 18 is a perspective view of left side of the exemplary mandrel cupping assembly of FIG. 11 in an open position showing an exemplary actuation scheme.
Figure 19:
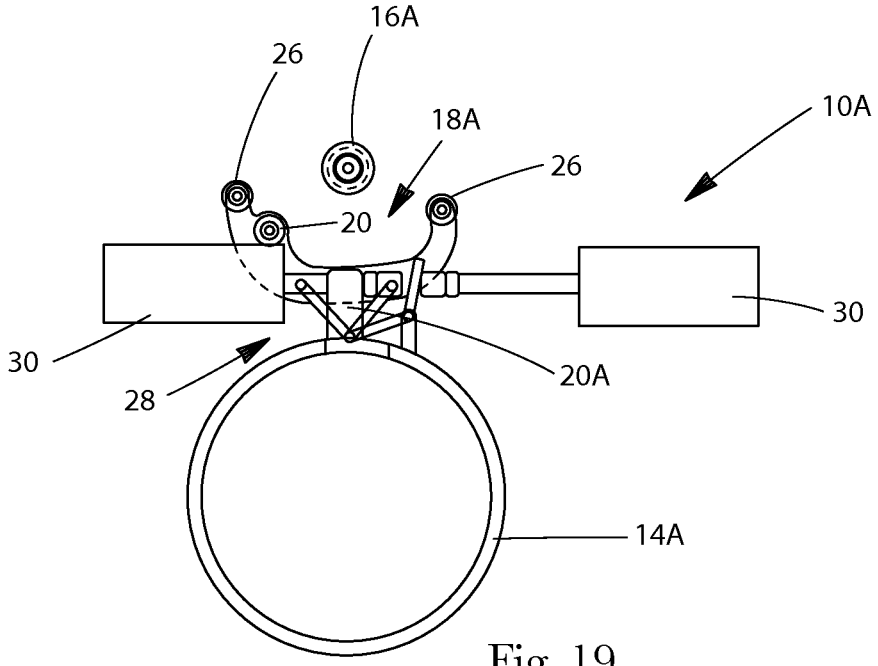
FIG. 19 is a planar end view of the exemplary mandrel cupping assembly of FIG. 11 in an open position showing an exemplary actuation scheme with actuators.
Figure 20:
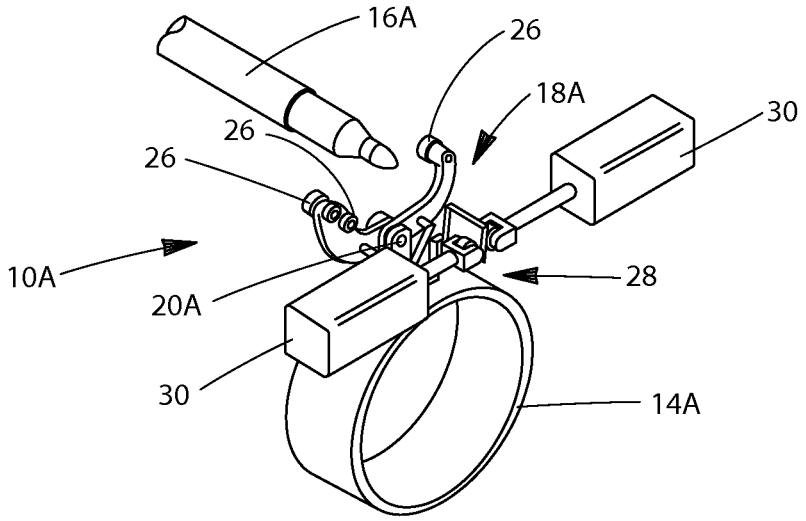
FIG. 20 is a perspective view of the left side of the exemplary mandrel cupping assembly of FIG. 15.
Figure 21:
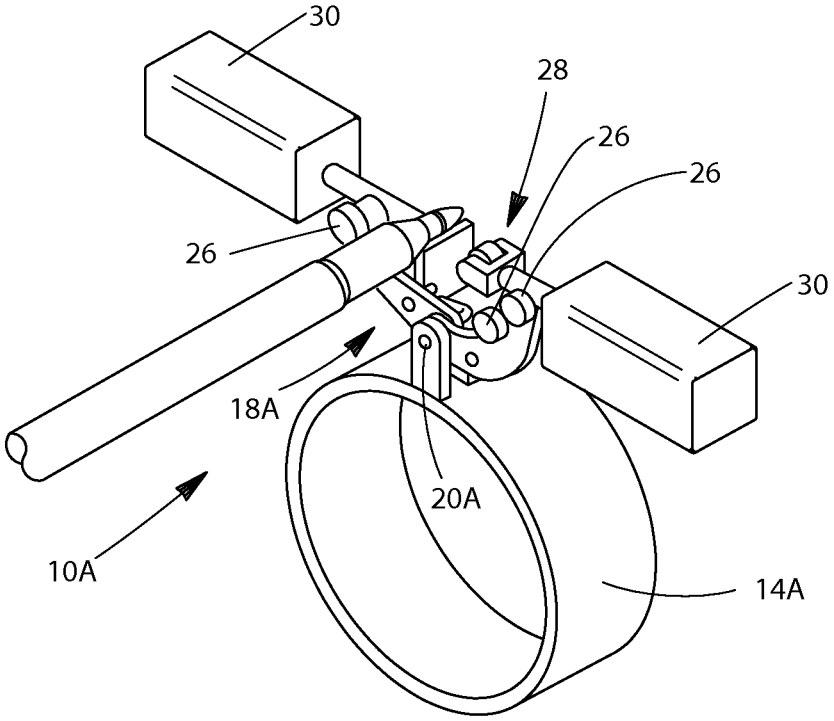
FIG. 21 is an alternative perspective view of the exemplary mandrel cupping assembly of FIG. 15.

An alternative embodiment shown in FIGS. 8-21 of the present disclosure and depicts various perspective and planar views of an exemplary cupping assembly 10A. While only one mandrel cup 18A is provided for illustrative purposes, it should be readily understood by one of skill in the art that the mandrel cupping assembly 10A would naturally be provided with a plurality of mandrel cups 18A. In the exemplary embodiment shown, the mandrel cupping assembly 10A is provided with mandrel cups 18A, where each mandrel cup 18A has cupping arms 12A that are disposed about a cupping spider 14A and are placed into contacting and un-contacting engagement with the free end of a web rewinding mandrel 16A. In other words, a mandrel cup supports the mandrel 22A for rotation of the mandrel 22A about its own rotational axis as well as its rotation (i.e., orbit) about the axis of the turret assembly. In this embodiment, the mandrel cup 18A can be provided in a passive configuration for movement (i.e., orbit) about cupping spider 14A, in a passive configuration, it is envisioned that the inertia of a particular spindle 22A due to its rotation about the axis of the turret assembly, once in mating engagement with a corresponding mandrel cup 18A will be sufficient to cause the corresponding mandrel cup 18A to orbit about cupping spider 14A in a cooperative, manner coincident with the mandrel 16A cooperatively associated thereto.

In a preferred embodiment, a mandrel cup 8A, is provided with a pair of cupping arms 12A that are provided as a first-class double-lever with a pivot acting as a fulcrum 20A. The ends of cupping arms 12A distal from the fulcrum 20A can be provided with rollers 26 for releaseably engaging the unsupported end of a mandrel 22A and supporting the mandrel 22A for rotation of the mandrel 22A about its own rotational axis as well as its rotation orbit) about the axis of a turret assembly.

As shown, the cupping arms 12A are provided with a device to constrain relative motion 26 of the mandrel 22A such as plurality of rollers and/or bearings disposed on the respective end of the cupping arm distal from the fulcrum 20A. One of skill in the art would understand that in any regard that any machine element that constrains the relative motion between the mandrel 22A, and the respective cupping arms 12A to only the desired type of motion is preferable. This can allow and promote free rotation around a fixed axis or free linear movement. It may also prevent any motion, such as by controlling the vectors of normal forces. Bearings may be classified broadly according to the motions they allow and according to their principle of operation, as well as by the directions of applied loads they can handle.

Exemplary but non-limiting devices that can constrain the relative motion between the mandrel 22A and the respective cupping arms 12A can include plain bearings (i.e., bushings, journal bearings, sleeve bearings, and rifle bearings), rolling-element bearings (i.e., ball bearings and roller bearings), jewel bearings (i.e., the load is carried by rolling the axle slightly off-center), fluid bearings (i.e., the load is carried by a gas or liquid), magnetic bearings (i.e., the load is carried by a magnetic field), and or flexure bearings (the motion is supported by a load element that bends).

The disposition of each cupping arm 12 forming mandrel cup 18 into contacting or non contacting engagement with a respective mandrel 16 is defined by cupping actuators 30. It is surprising to note, that the cupping assembly 10 of the present disclosure can be configured to only require the use of two actuators in order to provide engagement and disengagement of respective cupping arms 12 with a mandrel 16 cooperatively associated thereto. It is also important to understand that the cupping actuators 30 and any associated ancillary equipment of the present cupping assembly 10 do not necessarily need to rotate with a respective mandrel cup 28.

The mandrel cup 18 is designed to be utilized with a cupping actuator 30 that transfers each respective cupping arm 12 from the hold-open position to the hold-closed position. Similarly, the mandrel cup 18 is designed to be utilized with a cupping actuator 30 that transfers each respective cupping arm 12 from the hold-closed position to the hold-open position. In a preferred but non-limiting embodiment, the respective cupping/un-cupping actuator 30 can push/pull on a linkage of actuating mechanism 28 cooperatively associated with the respective mandrel cup 18. Alternatively, the respective cupping/un-cupping actuator 30 can push/pull directly upon cupping arms 12 upon engagement of the cupping actuator/un-cupping actuator 30 directly upon cupping arms 12. The hold-open position preferably provides a region suitable for the removal of the respective cupping arms 12 of mandrel cup 18 from the respective mandrel 16 and to provide the clearance necessary to facilitate removal of the material (e.g., core, core and material, etc.) disposed upon mandrel 16.

One of skill in the art will readily appreciate the fact that using only two actuating devices (actuators 30) greatly reduces the need for having a respective activation device for each mandrel cup 18 that may be associated with a cupping assembly of the prior art. Further, it will be readily appreciated by one of skill in the art as clearly advantageous in having such a cupping assembly 10 having only two actuating devices (actuator 30) in that such a system can allow cupping and tin-cupping actions to occur at virtually any point of the rotation of turret assembly as well as the respective mandrel cups 18 orbiting about cupping spider 14. This can include, but clearly not be hunted to, turret assembly dwell, turret assembly index, or any combination of the two. This is clearly advantageous over conventional cam track systems that require cupping and un-cupping actions to occur only while the turret is in motion. Clearly, one of skill in the art will appreciate that the system of the present invention provides less complexity by allowing increased product turn-over rates, reduced maintenance and repair times, as well as reduced maintenance and repair costs.

One of skill in the art will appreciate that the respective cupping arms 12 of mandrel cup 18 should be in a fully retracted position before the cupping arms 12 proceed past the position where the actuators 30 engages the cupping arms 12. This engagement causes cupping arms 12 to be positioned in hold-closed position and thus in contacting engagement with the unsupported end of a respective mandrel 16.

In is preferred embodiment the cupping arms 12 of mandrel cup 18 eventually reach a dwell position where the cupping arms 12 are fully retracted. In such a dwell position, a core can be loaded onto the respective mandrel 16. Then the cupping arm 12 of mandrel 18 can be directed inwardly toward the open end of the mandrel 16 in order to close the cup and fully support the previously unsupported end of the mandrel 16. The geometry and/or location of hold-open position is preferably designed to allow the turret assembly to cup during dwell, turret index, or any combination of the two. Practically, it was found that this design can allow more time to load a core onto a respective mandrel 16 and also facilitate higher turret assembly turn-over speeds. The cupping arms 12 of mandrel cup 18 can begin to retract once the mandrel cup 18 reaches a clear-out position. In this position, it is preferred that the cupping arms 12 be in a fully retracted position before the next incoming mandrel cup 18 approaches a clear in position.

One of skill in the art will appreciate that mandrel cup 18 could comprise a feature that utilizes the cupping motion to actuate means for locking a core onto respective mandrel 16. By way of non-limiting example, the cupping motion may cause axial compression of a deformable ring disposed at the cupping end of respective mandrel 16. This compression forces the ring to expand radially, thereby locking the core onto respective mandrel 16. Further, the core can also be driven onto a core stop disposed proximate to the spider end of the turret assembly prior to cupping. The core stop can be provided with tapered fins that are effectively wedged into the core when loading. Effectively, such a tapered stop and expanding ring can combine to lock the core onto the respective mandrel 16 at both ends providing a non-slipping drive engagement.

In another alternative, but non-limiting embodiment, the cupping motion could displace a moveable shaft disposed within the respective mandrel 16. Axial movement of the shaft would then cause locking pins disposed within respective mandrel 16 to protrude outside the outer diameter of the respective mandrel 16, thereby locking the core to the respective mandrel 16.

Referring to FIGS. 15-21, when the cupping arm 28 reaches the start of the hold open position, the un-cupping actuator of actuators 30 can engage cupping arms 12 and retracts to essentially un-cup the mandrel 16 and leave the end of the mandrel 16 unsupported. While the mandrel 15 is un-cupped in this position, the wound product (which now forms what is known to those of skill in the art as a log) can be stripped from the respective mandrel 16. The cupping arm 12 geometry and location is preferably designed to allow the turret assembly to un-cup during dwell, turret assembly index, or any combination of the two. The turret assembly then begins to index and the un-cupping actuator of actuators 30 begins to extend once the cupping arms 12 reach a clear-out position.

In a preferred embodiment, the hold-open position is designed to maximize time to strip the log comprising wound product from the mandrel 16 and to maximize turn-over for the placement of a new core upon mandrel 16. One of skill in the art will understand that the un-cupping actuator of actuators 30 should be in the fully extended position before the next incoming mandrel cup 18 gets beyond a clear-in position.

In a preferred embodiment, both actuators 30 (cupping and un-cupping) are provided as linear motors. However one of skill in the art will understand that it would also be possible to provide an embodiment of the cupping assembly 10 where the actuators 30 are provided as a four-port, two-position valve having an axially slideable valve element. In such an embodiment, both actuators 30 can be operated by the use of compressed air or any other fluid suitable for use in such constructions. By providing actuators 30 in a linear relationship with the mandrel cup 18 and the associated cupping arms 12, it is possible to provide, a cupping assembly 10 that requires the use of only two actuators to provide the intended function of cooperatively associating or disassociating the unsupported end of the mandrel 16. However, it should be recognized that the mandrel cup 18 can be disposed about the circumference of cupping spider 14 so that an individual mandrel cup 18 is cooperatively associated with only one mandrel 16.

An unloading mechanism (not shown) can be started as soon as the mandrel cup 18 associated with the mandrel 16 having wound product disposed thereon, has reached the start of hold open position. Starting of the unloading mechanism can be coordinated with mandrel cup 18 opening in any of several manners. For example, a start signal can be issued after a predetermined delay interval followed by the end of indexing motion. Alternatively, the unloading mechanism can be stopped at the end of each unloading operation in such a position that when restarted for the next operation, the pusher moves a substantial distance before coming into engagement with wound product disposed about a mandrel 16 forming the outgoing log. In such a case, the unloading mechanism can be started in operation simultaneously with delivery of the opening input to the unloading station.

Once the mandrel cup 18 is engaged with the unsupported end of the mandrel 16 after loading of a core upon mandrel 16 in the loading position, it remains in that position until the turret assembly indexes to carry the mandrel 16 out of the loading position. Furthermore, as the mandrel 16 moves away from the loading position and its associated mandrel cup 18 is engaged into the hold-closed position, the mandrel cup 18 is maintained in its engaged position with the now supported end of mandrel 16. The turret assembly then indexes the mandrel 15 and associated mandrel cup 18 about its longitudinal axis until web product is contactingly engaged with the core disposed upon the mandrel 16. At this point, mandrel 16 is spun up (i.e., rotational inertia is imparted) and as discussed supra coincides with the winding of a web material about the core disposed about mandrel 16 to form a wound product.

Upon reaching the unloading position disposed proximate to the start of hold-open position, un-cupping actuator or actuators 30 can then be engaged to cupping arms 12 (with or without the use of a chucking lever) to retract the cupping arms 12 from contacting engagement with a corresponding mandrel 16 and positioning the cupping arms 12 into the hold-open position. Positioning of the cupping arm 28 into the hold-open position then facilitates the mandrel 15 having wound product disposed thereon to be removed from mandrel 16. The cupping arms 12 remain open in order to clear any required supports. The mandrel cup 18 and cupping arms 12 can then freely orbit about the axis of cupping assembly 10 (or orbit with cupping assembly 10) in the hold-open position in preparation for movement of the next mandrel 16 into the unloading position and egress of ensuing wound product.

By reference, a core may be started onto the mandrel 16 at the loading position by means of a core loading apparatus as would be known by those of skill in the art. After the core has run onto the mandrel 16 a known distance, the core can then be engaged by a rotating loading wheel known to those of skill in the art that initially cooperates with the core loading apparatus and moving the core onto the mandrel 16 but which takes over the propulsion of the core in the last part of movement onto the mandrel 16.

Further, as would be known by those of skill in the art, when a core is properly positioned on the mandrel 16, its front end preferably engages in an abutment located near the spider supporting the mandrels 16. After it engages the abutment, the core cannot be advanced any further by the rotating core loading wheel which would then merely slip relative to the core. At about the time that the core engages the abutment, its front end portion moves under an arm that typically comprises a core detector. Such an apparatus may comprises, spring arm having a free end portion that is biased towards contacting engagement with the mandrel 16 at the loading station and a properly loaded core intervenes between the associated spring arm and the mandrel 16 to break contact between them and thus open an electric signal circuit through the spring arm.

As would be understood by those of skill in the art, interruption of the circuit typically comprising an output signifying core presence can cause rotation of the associated core loading wheel to be stopped and engagement of a mandrel cup 18 upon the mandrel 16 by operation of the cupping actuator of actuators 30 causing the mandrel cup 18 to engage the unsupported end of a mandrel 16 having the core disposed thereupon. Such a core presence signal can also be issued to a PCD, PLC, or other synchronizing mechanism for the apparatus and its issuance is in any case a condition or the condition for retraction of the mandrel cup 18 at the appropriate position. Such retraction, as pointed out above, constitutes a closing input to the control element for the mandrel cup 18 to be positioned back into contacting engagement with its respective mandrel 16. Thus, the mandrel cup 18 is in the closed position only if and when a core is present on the mandrel 16 at the loading station and before the mandrel 16 begins to move out of that station.

It should be realized by one of skill in the art that engagement of the mandrel cup 18 upon the mandrel 16 could also occurs just prior to any core presence signal being detected. It should be recognized that the core should be clear of the mandrel cup 18 before the mandrel cup 18 moves toward the mandrel 16.

In a preferred embodiment, since the mandrel cup 18 can be moved into the closed position where contacting engagement occurs between the mandrel cup 18 and the respective mandrel 16 and likely after the mandrel 16 has been subjected to vibration dampening, it is unlikely that the conical end portion typically associated with the mandrel 16 will fail to seat in the bearing socket of the mandrel cup 18. However, in the event of such a failure, the cupping actuator or actuators 30 can be merely programmed to stop short of its limit position where the mandrel cup 18 is closed, thus eliminating damage that can result because the mandrel cup 18 will be urged past the stationary mandrel 16 under yielding pressure from mandrel cup 18.

Any dimensions and values disclosed herein are not to be understood as being strictly limited to the exact dimension and values recited. Instead, unless otherwise specified, each such dimension and/or value is intended to mean both the recited dimension and/or value and a functionally equivalent range surrounding that dimension and/or value. For example, a dimension disclosed as "40 mm" is intended to mean "about 40 mm".

All documents cited in the Detailed Description of the Invention are, in relevant part, incorporated herein by reference; the citation of any document is not to be construed as an to admission that it is prior art with respect to the present invention. To the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended chums all such changes and modifications that are within the scope of this invention.

What is claimed is:

1. A mandrel cupping assembly for releaseably engaging unsupported ends of a plurality of mandrels disposed on a web winding turret assembly having a web winding turret assembly axis, each of said plurality of mandrels extending generally parallel to said web winding turret assembly axis, each of said mandrels being driven in a closed mandrel path about said web winding turret assembly axis, said mandrel cupping assembly comprising:

a cupping spider having a cupping spider axis;

a mandrel cup cooperatively associated with each mandrel of said plurality of mandrels, each of said mandrel cups being disposed radially about said cupping spider, each of said mandrel cups comprising a pair of cupping arms configured as a first-class double-lever with a pivot acting as a fulcrum;

wherein each of said mandrel cups releaseably engages said unsupported end of said mandrel, each of said mandrel cups having a hold-open position and a hold-closed position, each of said mandrel cups being carried in a radial orbital path about said cupping spider axis while disposed in either of said hold-open position or said hold-closed position;

a first actuator for disposing said cupping arms from said hold-open position to said hold-closed position; and, a second actuator for disposing said cupping arms from said hold-closed position to said hold-open position.

2. The mandrel cupping assembly of claim 1 wherein disposing said cupping arms from said hold-open position to said hold-closed position further comprises engaging said cupping arms with said mandrel cooperatively associated thereto.

3. The mandrel cupping assembly of claim 1 wherein disposing said cupping arms from said hold-closed position to said hold-open position further comprises disengaging said cupping arms from said mandrel cooperatively associated thereto.

4. The mandrel cupping assembly of claim 1 wherein disposing said cupping arms from said hold-closed position to said hold-open position further comprises disengaging said cupping arms from said mandrel cooperatively associated thereto.

5. The mandrel cupping assembly of claim 1 wherein said cupping arms are indexably rotatable about said radial path.

6. The mandrel cupping assembly of claim 5 wherein said cupping arms are manually advanceable from a first position to a second position about said radial path.

7. The mandrel cupping assembly of claim 1 wherein said first actuator is fixably disposed upon a cupping arm support relative to said hold-open position.

8. The mandrel cupping assembly of claim 1 wherein said cupping arms cooperatively associated with each mandrel dwells in each of a plurality of positions about said cupping arm turret.

9. The mandrel cupping assembly of claim 8 wherein one of said plurality of positions provides for disposition of a core upon one of said plurality of mandrels when said cupping arms are disposed in said hold-open position.

10. The mandrel cupping assembly of claim 9 wherein a second of said plurality of positions provides for disposition of a web substrate upon said core when said cupping arms are disposed in said hold-closed position.

11. The mandrel cupping assembly of claim 10 wherein at least one of said plurality of positions provides for removal of said core and said web substrate disposed thereabout when said cupping arms are disposed in said hold-open position.

12. The mandrel cupping assembly of claim 1 wherein at least one of said cupping arms comprises a detent configured to engage said unsupported end of said mandrel cooperatively associated thereto.

13. The mandrel cupping assembly of claim 12 wherein said at least three motion limiting devices are configured to encircle said unsupported end of said mandrel cooperatively associated thereto when said ends of said cupping arms distal from said pivot are cooperatively engaged with said mandrel.

14. The mandrel cupping assembly of claim 13 wherein said motion limiting devices are bearings, said bearings being cooperatively engageable with said when said ends of said cupping arms distal from said pivot are cooperatively engaged with said mandrel.

15. The mandrel cupping assembly of claim 1 wherein said mandrel cup is capable of engaging said mandrel cooperatively associated thereto at any point within said closed mandrel path.

16. The mandrel cupping assembly of claim 1 wherein said mandrel cup is capable of disengaging from said mandrel cooperatively associated thereto at any point within said closed mandrel path.

* * * * *